US011933141B2

(12) United States Patent
Dockweiler

(10) Patent No.: US 11,933,141 B2
(45) Date of Patent: Mar. 19, 2024

(54) MULTIPLE CYCLE DEPLOYABLE AND RETRACTABLE DOWNHOLE SCRAPER OR BRUSH

(71) Applicant: Halliburton Energy Services, Inc., Houston, TX (US)

(72) Inventor: David Allen Dockweiler, Singapore (SG)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 17/835,765

(22) Filed: Jun. 8, 2022

(65) Prior Publication Data

US 2023/0399921 A1 Dec. 14, 2023

(51) Int. Cl.

| | |
|---|---|
| ***E21B 37/04*** | (2006.01) |
| ***E21B 23/00*** | (2006.01) |
| ***E21B 23/04*** | (2006.01) |

(52) U.S. Cl.

CPC ..... *E21B 37/04* (2013.01); *E21B 23/006* (2013.01); *E21B 23/0413* (2020.05)

(58) Field of Classification Search

CPC ..... E21B 37/04; E21B 23/006; E21B 23/0413

See application file for complete search history.

(56) References Cited

U.S. PATENT DOCUMENTS

| | | | | |
|---|---|---|---|---|
| 5,413,180 | A | 5/1995 | Ross et al. | |
| 2009/0025927 | A1* | 1/2009 | Telfer | E21B 37/04 166/174 |
| 2016/0312582 | A1 | 10/2016 | Ali et al. | |
| 2017/0306723 | A1 | 10/2017 | Dockweiler | |
| 2019/0226294 | A1 | 7/2019 | Hansen | |
| 2020/0080400 | A1 | 3/2020 | Garcia | |
| 2020/0115997 | A1 | 4/2020 | Stang et al. | |

OTHER PUBLICATIONS

International Search Report and Written Opinion for International Patent Application No. PCT/US2022/033709 dated Mar. 2, 2023.

* cited by examiner

*Primary Examiner* — Nicole Coy
*Assistant Examiner* — Nicholas D Wlodarski
(74) *Attorney, Agent, or Firm* — Scott Richardson; C. Tumey Law Group PLLC

(57) ABSTRACT

Systems and methods of the present disclosure relate to wellbore scraping operations. A method comprises running a scraper tool into a wellbore with blades retracted; dropping a ball into an expandable seat of the scraper tool to build pressure; pumping fluid into the scraper tool to deploy a mandrel to compress a spring to rotate a j-slot to a second position from a first position to extend the blades; building pressure until the ball is released from the expandable seat; and moving the mandrel to a third position on the j-slot to lock the extended blades in place.

20 Claims, 9 Drawing Sheets

MULTIPLE CYCLE DEPLOYABLE AND RETRACTABLE DOWNHOLE SCRAPER OR BRUSH

BACKGROUND

Currently, downhole scraper tools for wellbore cleanout are limited to scraper tools that have the scraper blades always deployed; and scraper tools that have the blades retracted as they are run into the wellbore and subsequently activated to extend, but unable to retract back. These limits prevent tools from being run through wellbore restrictions or other equipment in the completion string.

BRIEF DESCRIPTION OF THE DRAWINGS

These drawings illustrate certain aspects of some examples of the present disclosure and should not be used to limit or define the disclosure.

DETAILED DESCRIPTION

The present disclosure relates to techniques that allow for scraper blades or brushes to extend and retract due to pressure. In some examples, a scraper tool may be deployed into a cased wellbore with a slim outer diameter (OD) with the blades retracted. The blades may then be extended for a wellbore cleaning operation. After scraping/cleaning of the casing, the blades may be retracted prior to pulling out of the wellbore. Examples may use a spring-loaded deployment/retraction system. The spring system is connected to a rotating j-slot mechanism.

The rotating j-slot has three positions, deployed blades, retracted blades, and transition. The spring-loaded mechanism can be activated by ball activation, flow activation, and/or compression). For example, the mechanisms can be adapted to be activated via ball drop with an expanding ball catcher, via flow with a flow restriction mechanism to build pressure on the backside and compress the spring, or via a simple modification to the spring mechanism adapted to be activated via compression of the work string on a liner top.

Each compression of the spring rotates the j-slot from retracted to transition to deployed to transition to retracted and so on an unlimited number of times. The blades are mechanically inclined to be in the retracted position via springs. The springs that allow the blade to compress against the casing are independent from the retraction blades.

Figure 1:
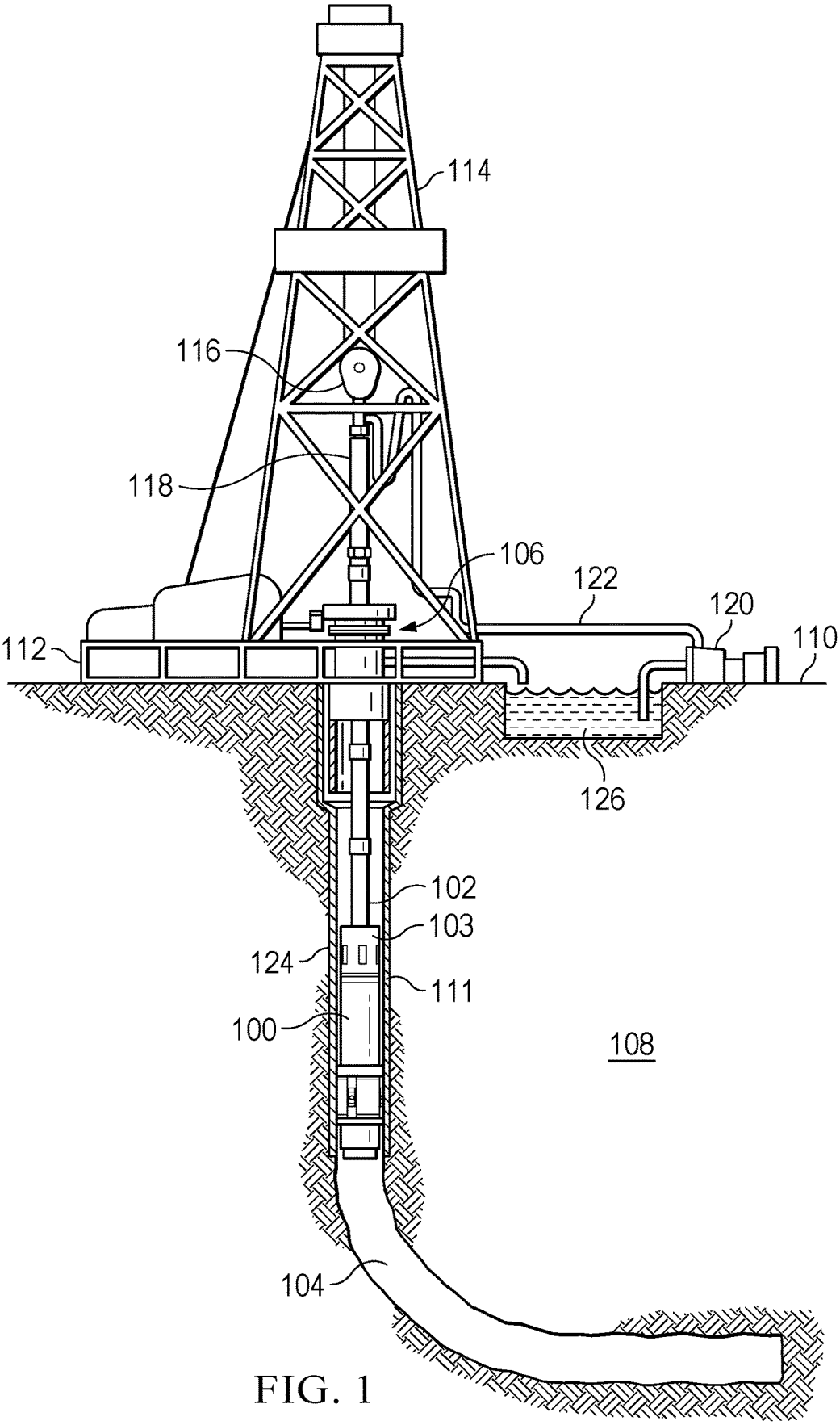
FIG. 1 illustrates an operating environment for a wellbore scraper tool, in accordance with examples of the present disclosure.

FIG. 1 illustrates an operating environment for a wellbore cleaning tool (e.g., a scraper tool 100), in accordance with examples of the present disclosure. It should be noted that while FIG. 1 generally depicts a land-based operation, those skilled in the art may recognize that the principles described herein are equally applicable to subsea operations that employ floating or sea-based platforms and rigs, without departing from the scope of the disclosure.

The scraper tool 100 may be operatively coupled to a conveyance 102 (e.g., rigid pipe) via a top sub 103. The conveyance 102 may provide mechanical suspension for the scraper tool 100. A wellbore 104 may extend from a wellhead 106 into a subterranean formation 108 from a surface 110. At least a portion of the wellbore 104 may include casing 111. The wellbore 104 may include horizontal, vertical, slanted, curved, and other types of wellbore geometries and orientations.

A platform 112 may support a derrick 114 having a traveling block 116 for raising and lowering the conveyance 102. A top drive or kelly 118 may support the conveyance 102 as it may be moved into or out from the wellbore 104 that may include cased and/or uncased sections. A pump 120 may circulate fluid through a feed pipe 122 downhole through the interior of the tool 100, back to the surface 110 via an annulus 124 and into a retention pit 126.

Figure 2:
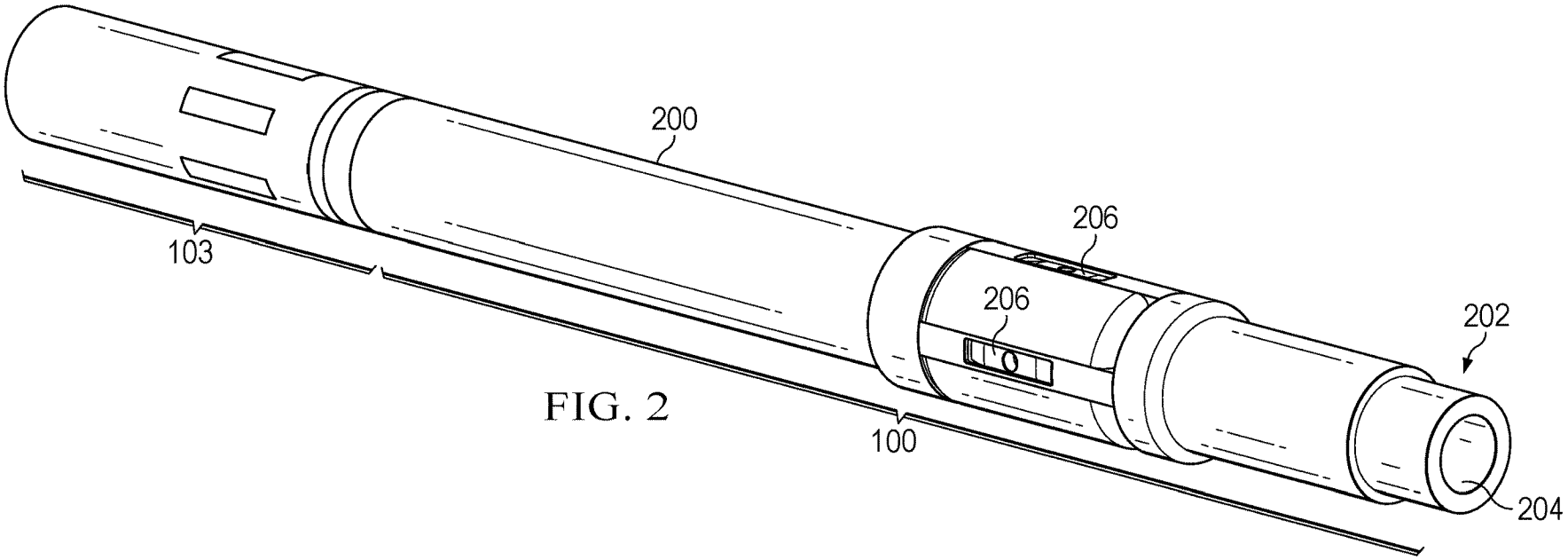
FIG. 2 illustrates a close-up view of the scraper tool, in accordance with examples of the present disclosure.

FIG. 2 illustrates a close-up view of the scraper tool 100, in accordance with some examples of the present disclosure. The scraper tool 100 may include a tool body 200 that may be of a tubular shape operable to pass fluid therethrough (e.g., internal passage(s)). The scraper tool 100 may be attached via threaded connection to the top sub 103 that allows incorporation of the scraper tool 100 into a work string, for example.

A downhole end 202 of the scraper tool 100 may include an outlet 204 (e.g., ball catcher assembly) for the egress of fluid passed through the scraper tool 100 and/or to catch the dropped ball. A plurality of blades 206 may be arranged along a circumference of a portion of the tool body 200 and may be operable to extend and retract (shown), for example, due to fluid passed through the scraper tool 100.

Figure 3A:
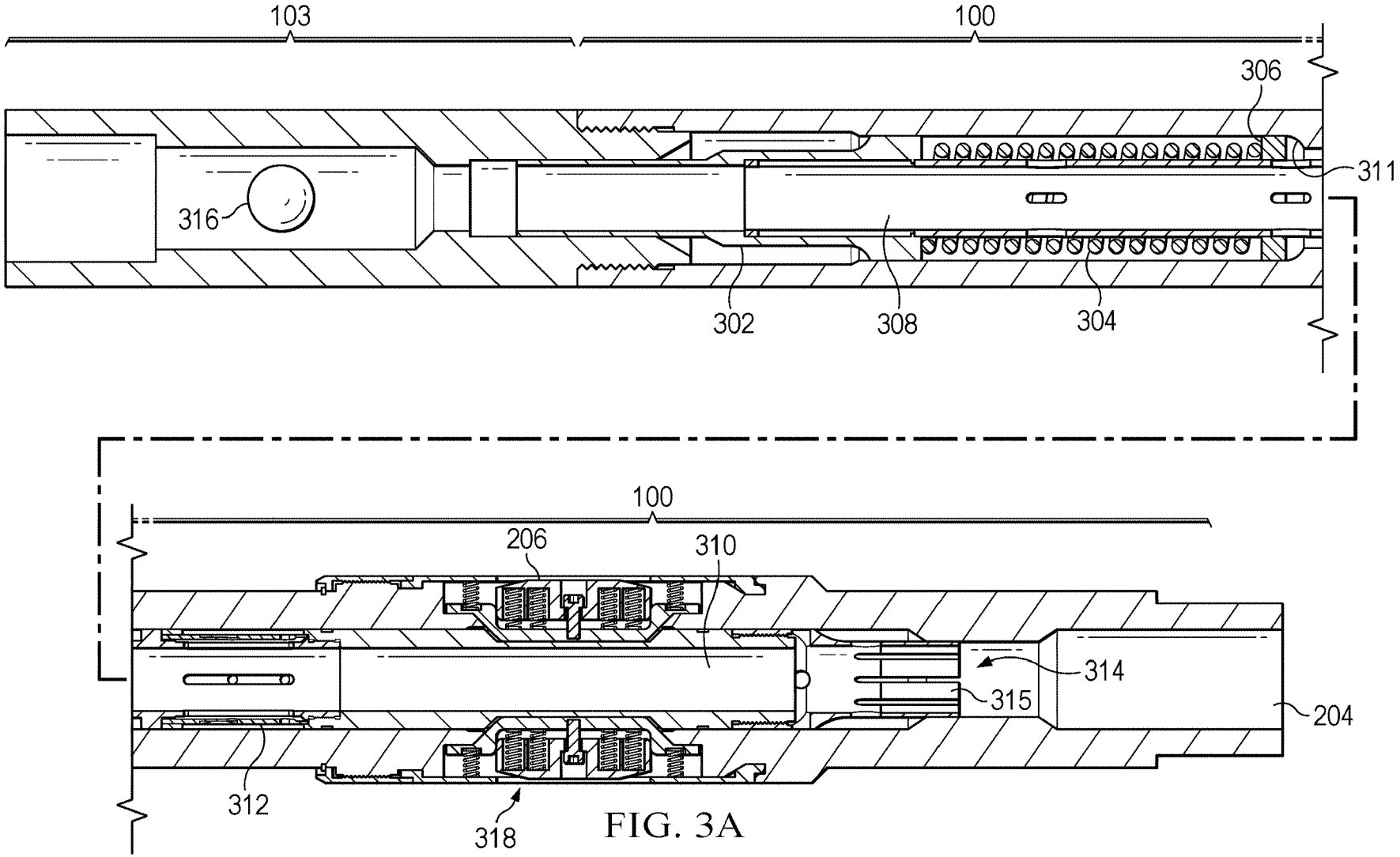
FIG. 3A illustrates a cross-section of the scraper tool, in accordance with examples of the present disclosure.

FIG. 3A illustrates a cross-section of the scraper tool 100, in accordance with some examples of the present disclosure. A top sub 103 may be coupled to the scraper tool 100 thereby forming a passage extending to the outlet 204. A spring retainer 302 may be disposed within the scraper tool 100. The spring retainer 302 is operable to move axially within the scraper tool 100.

A spring 304 (e.g., power spring) may be disposed longitudinally between the retainer 302 and a load transfer ring 306 that may be disposed around a sleeve 308. As shown, the spring 304 is in an expanded state. The load transfer ring 306 does not move forward (downhole direction) due to a reduced internal diameter portion 311 of the scraper tool 100.

The sleeve 308 may be coupled to the spring retainer 302 and a deployment mandrel 310. A rotating j-slot 312 is disposed around a portion (distal end) of the sleeve 308. The rotating j-slot 312 is adjacent to the deployment mandrel 310. A portion of the deployment mandrel 310 may overlap the rotating j-slot 312. A flow restriction 314 may be coupled to a distal end of the deployment mandrel 310. The flow restriction 314 may include a collet 315 (fingers) to catch a ball 316.

Once received in the collet 315, the ball 316 reduces flow thereby increasing pressure to move the deployment mandrel 310 forward and actuating blade mechanisms 318 to deploy blades 206. The blade mechanisms 318 may be arranged along a circumference of the scraper tool 100. As the pressure is increased, the spring 304 is compressed due to the mandrel 310 being pulled forward by the restriction 314. The ball 316 may be released from the flow restriction as the collet 315 expands (e.g., expandable seat) in an internal portion of the scraper tool 100 that includes a larger outer diameter (OD) (the outlet 204) than the OD of the collet 315.

Figure 3B:
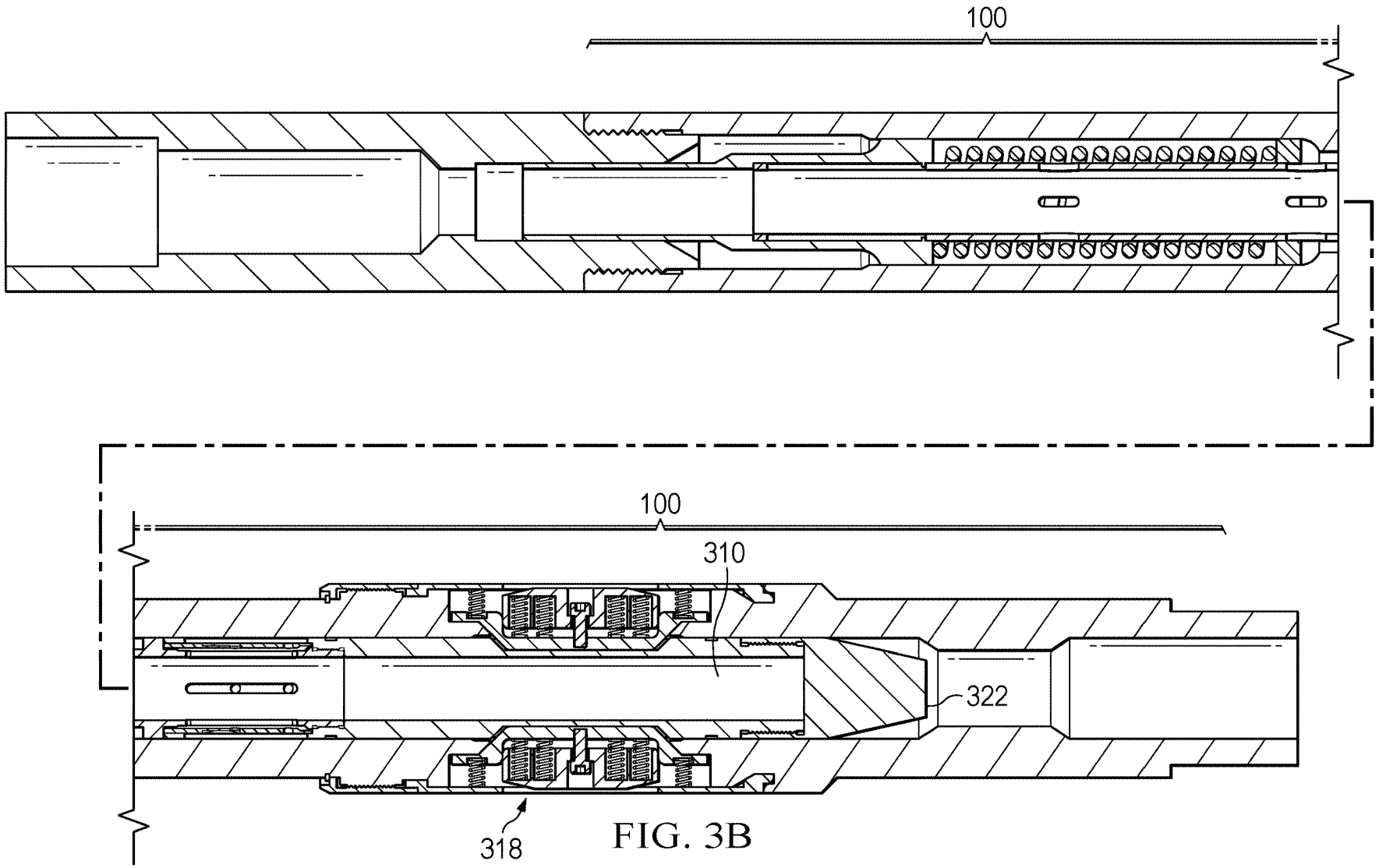
FIG. 3B illustrates an alternate example of flow restriction, in accordance with examples of the present disclosure.

FIG. 3B illustrates an alternate example of flow restriction, in accordance with examples of the present disclosure. For example, rather than the collet and ball, a choke 322 may be disposed at the distal end of the deployment mandrel 310. The choke 322 may include an inner diameter reduction (tapering) to increase pressure in the scraper tool 100. The choke 322 moves forward thereby pulling the mandrel 310, upon pressurization, to actuate the blade mechanism 318.

Figure 4:
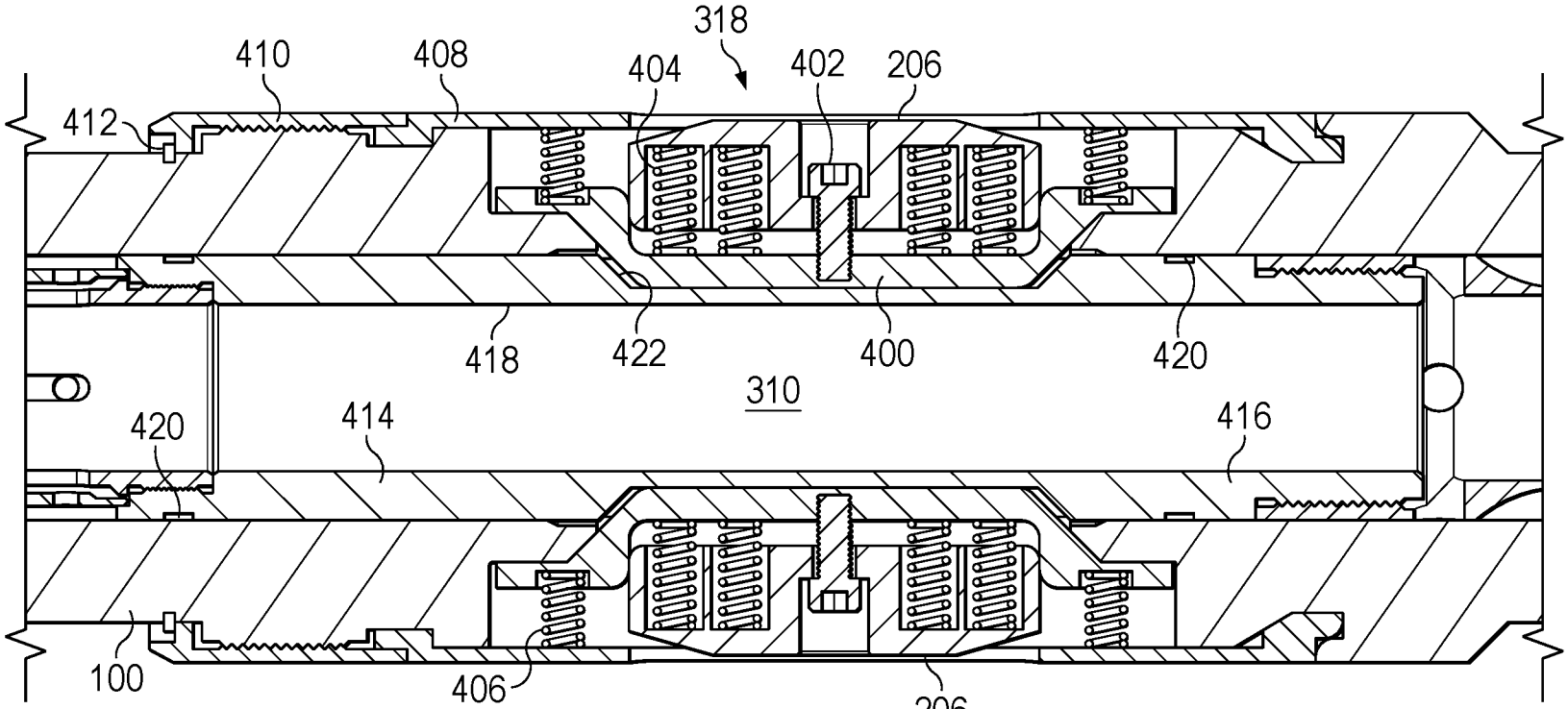
FIG. 4 illustrates a close-up view of blade mechanisms with the blades in a retracted state, in accordance with examples of the present disclosure.

FIG. 4 illustrates a close-up view of the blade mechanisms 318 with the blades 206 in a retracted state, in accordance with examples of the present disclosure. The blades 206 may be coupled to blade carriers 400 via a retention screw 402. The blade carriers 400 are movable members to retract and expand the blades 206.

Blade springs 404 may be in an expanded state to retract the blades 206. Additional retraction springs 406 may also be in an expanded state thereby pushing the blade carrier 400 to retract the blades 206. Retainers 408 and 410 may be used to secure the blade mechanisms 318 in place within the scraper tool 100. A retaining ring 412 may be used to secure the retainer 410 which may be used to secure the retainer 408 that secures the springs 406.

The deployment mandrel 310 may include end portions 414 and 416 that are flared or include larger ODs than the middle section 418 (a recess). Seals may be placed in grooves 420. Also, each of end portions 414 and 416 may include a ramp 422 to allow sliding of the deployment mandrel 310 underneath the blade carriers 400 to extend or retract the blades 206.

Figure 5:
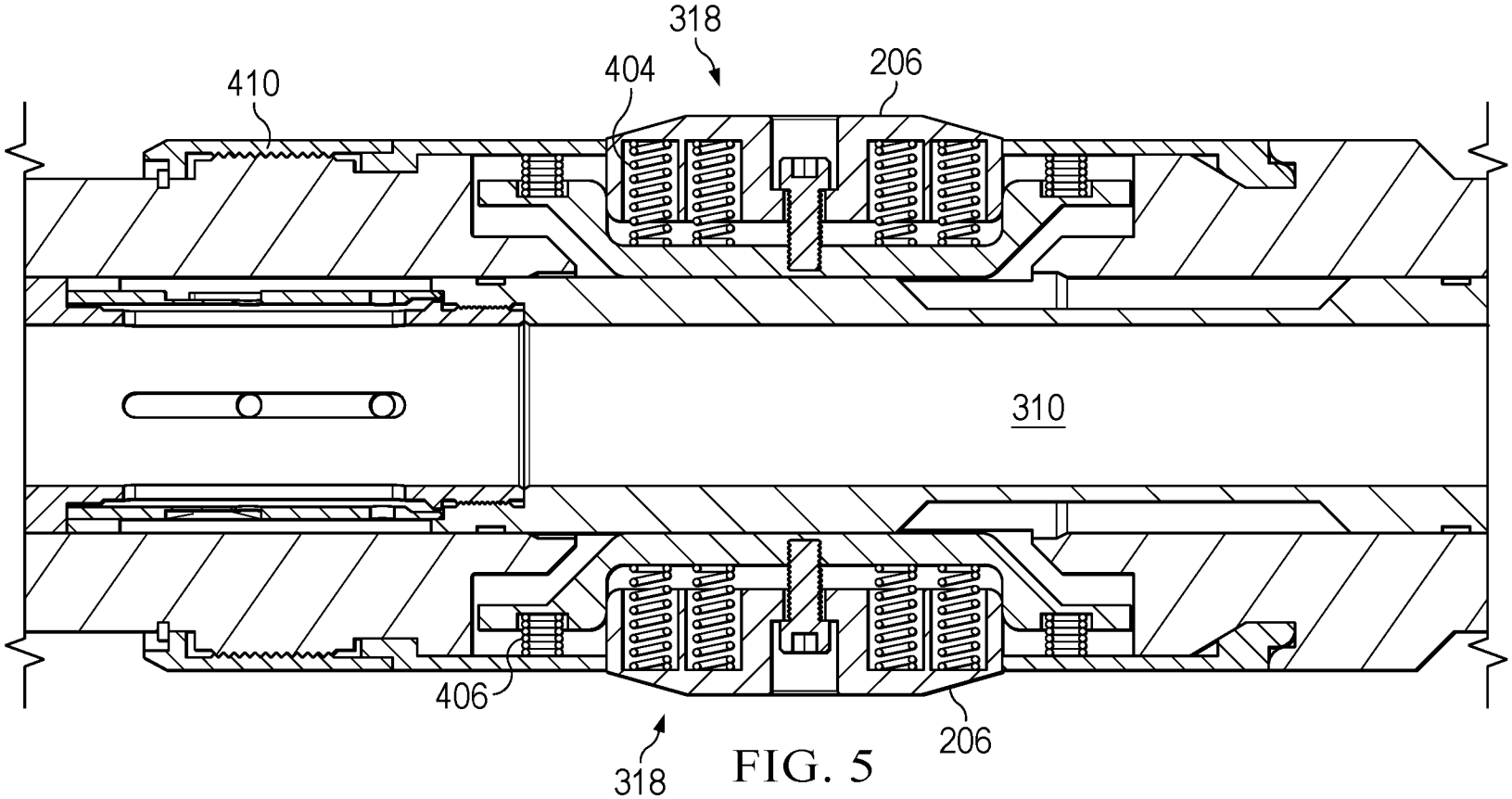
FIG. 5 illustrates the blade mechanisms with the blades in an expanded state, in accordance with examples of the present disclosure.

FIG. 5 illustrates the blade mechanisms 318 with the blades 206 in an extended state, in accordance with some examples of the present disclosure. The deployment mandrel 310 moves forward upon pressurization to extend the blades 206, as shown. The springs 404 and 406 may compress as the deployment mandrel 310 moves.

Figure 6:
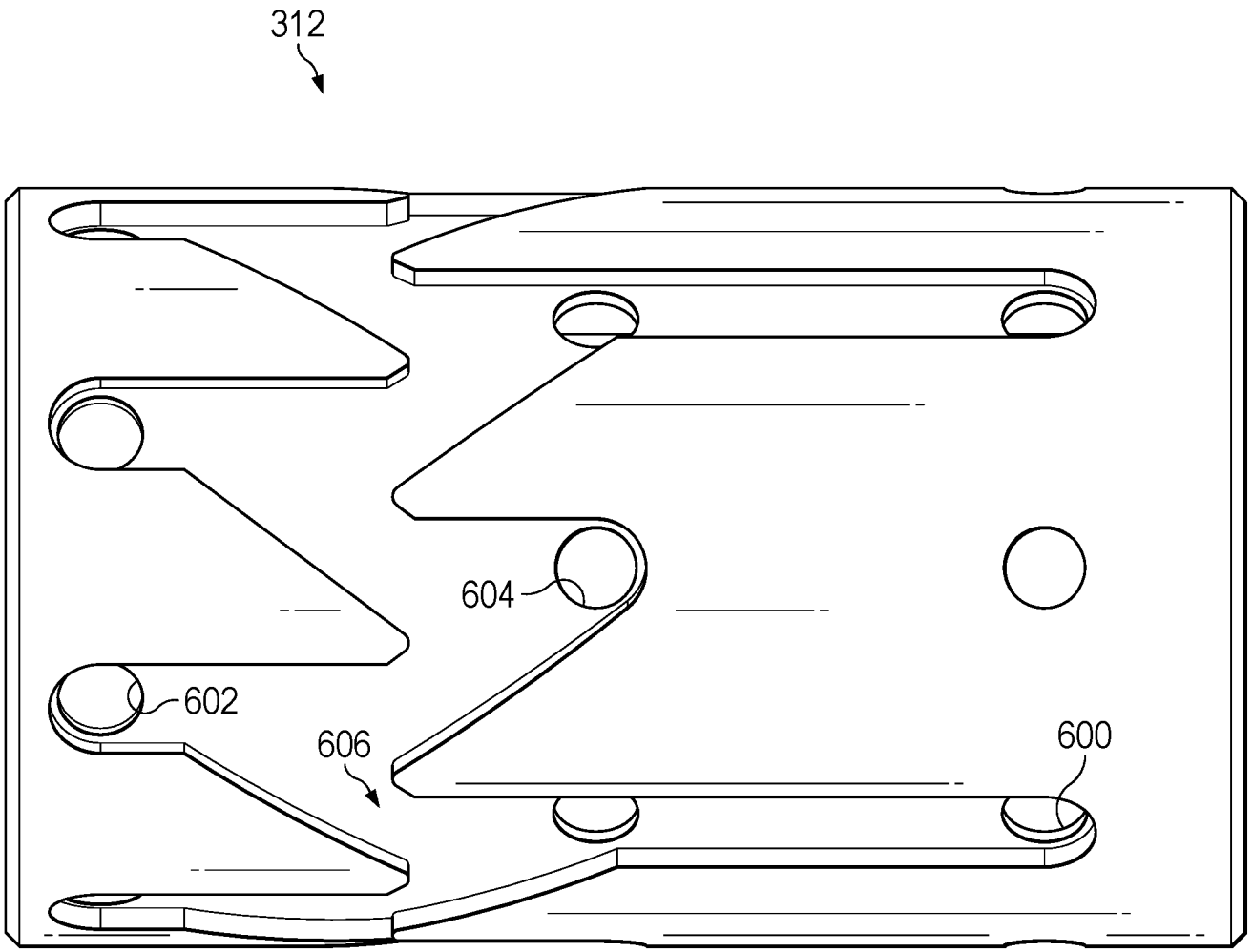
FIG. 6 illustrates a rotating j-slot, in accordance with examples of the present disclosure.

FIG. 6 illustrates the rotating j-slot 312, in accordance with examples of the present disclosure. The rotating j-slot 312 may allow the blades to extend and retract as the j-slot 312 is rotated through different positions upon increasing or decreasing of pressure in the tool. For example, in a first position 600, the blades are in a retracted position as shown in FIG. 4. Pressure is then increased to rotate the j-slot 312 to a second position 602 to extend the blades, and at a third position 604, the blades are locked in the extended position (i.e., flow has stopped or the ball has been released), as shown on FIG. 5. Extension or retraction of blades is dependent on the position of the rotating j-slot 312 which may be rotated due to pressure manipulation within the tool.

Figure 7:
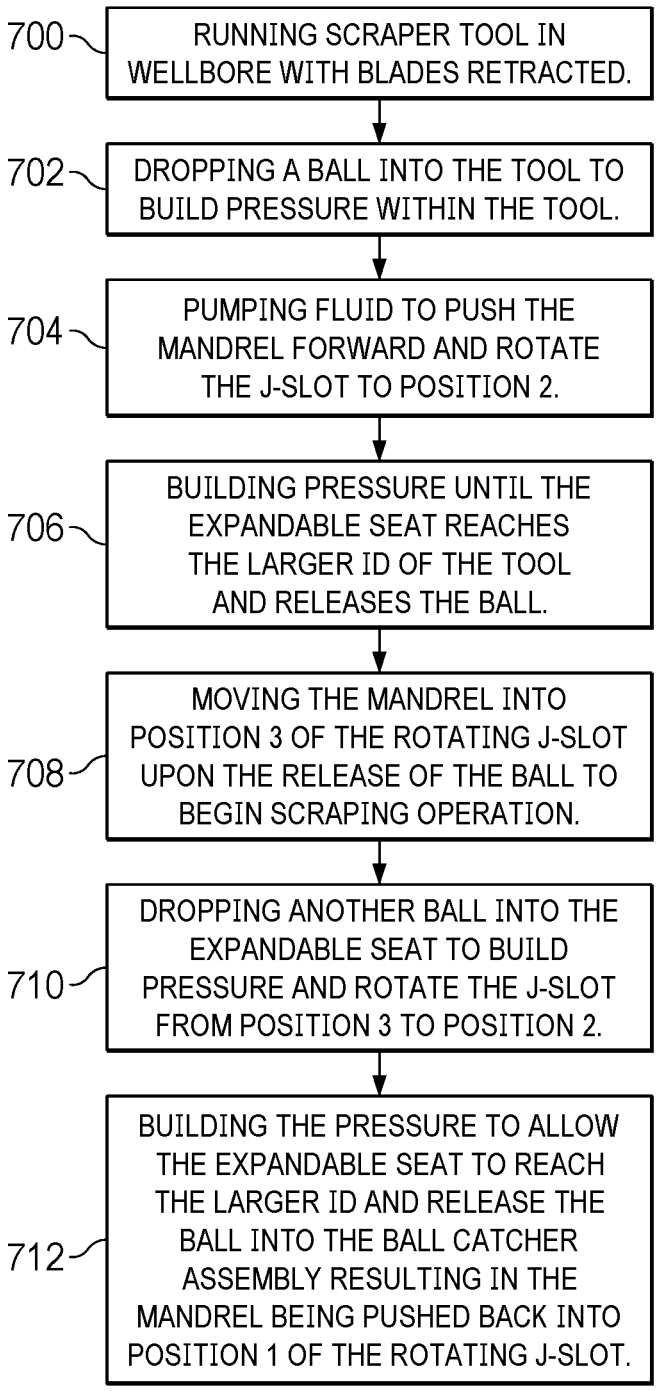
FIG. 7 illustrates an operational sequence for the scraper tool using a dropped ball, in accordance with examples of the present disclosure.

FIG. 7 illustrates an operational sequence for the scraper tool using a dropped ball, in accordance with examples of the present disclosure. At step 700, the tool is run in hole (RIH) (e.g., FIG. 1). The blades are in a retracted position (e.g., FIG. 4 and position 1 on FIG. 6). At step 702, a ball may be dropped into the tool (e.g., FIG. 3A) and land in the expandable seat (collet) to pull the mandrel forward and compress the spring, upon pressurization.

At step 704, fluid may be pumped to increase pressure in the tool to push the mandrel forward (spring compression) and rotate the j-slot to position 2 on FIG. 6. At step 706, the pressure may be increased or maintained (continued) until the expandable seat (collet) reaches the larger ID (outlet) of the tool and releases the ball into a ball catcher assembly, as shown on FIG. 3A, for example.

At step 708, the ball is released and the spring pushes the mandrel into position 3 of the rotating j-slot. The blades are extended with full flow and a scraping operation may commence. At step 710, another ball is dropped into the expandable seat and the pressure is built.

The mandrel compresses the spring to rotate the J-slot from position 3 to position 2. At step 712, the pressure is continued to allow the expandable seat to reach the larger ID and release the ball into the ball catcher assembly. Once the ball is released, the spring pushes the mandrel back into position 1 (retraction of blades) of the rotating J-slot.

Figure 8:
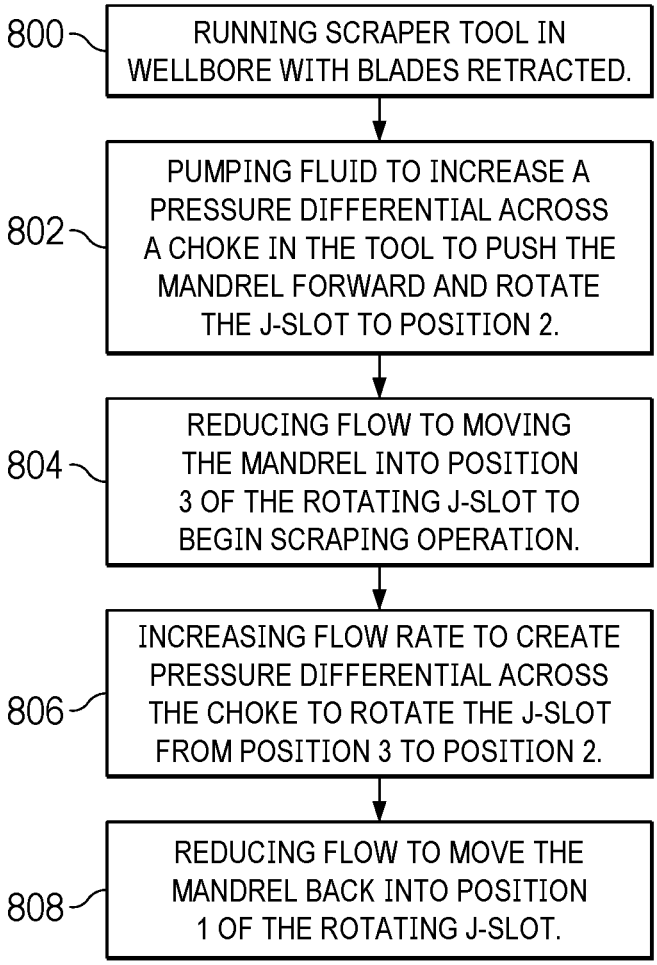
FIG. 8 illustrates an operational sequence for the scraper tool using a flow choke, in accordance with examples of the present disclosure.

FIG. 8 illustrates an operational sequence for the scraper tool using a flow choke, in accordance with examples of the present disclosure. At step 800, the tool is RIH with blades retracted. At step 802, fluid is pumped into the tool to increase a pressure differential across a choke in the tool to push the mandrel forward (spring compression) and rotate the J-slot to position 2. At step 804, the flow is reduced to move the mandrel into position 3 of the rotating j-slot to begin a scraping operation.

At step 806, the flow rate is increased to create a pressure differential across the choke to rotate the J-slot from position 3 to position 2. At step 808, the flow is reduced to move the mandrel back into position 1 of the rotating j-slot.

Accordingly, the systems and methods of the present disclosure allow for extension and retraction of blades for scraping operations in cased wellbores. The systems and methods may include any of the various features disclosed herein, including one or more of the following statements.

Statement 1. A method comprises running a scraper tool into a wellbore with blades retracted; dropping a ball into an expandable seat of the scraper tool to build pressure; pumping fluid into the scraper tool to deploy a mandrel and compress a spring to rotate a j-slot to a second position from a first position to extend the blades; building pressure until the ball is released from the expandable seat; and moving the mandrel to a third position on the j-slot to lock the extended blades in place.

Statement 2. The method of the statement 1, further comprising scraping casing within the wellbore.

Statement 3. The method of the statement 1 or the statement 2, further comprising dropping another ball into the expandable seat of the scraper tool to build pressure a second time.

Statement 4. The method of any one of the statements 1-3, further comprising rotating the j-slot back to the second position from the third position.

Statement 5. The method of any one of the statements 1-4, further comprising building pressure to release the another ball.

Statement 6. The method of any one of the statements 1-5, further comprising moving the mandrel back to the first position.

Statement 7. The method of any one of the statements 1-6, wherein deployment of the mandrel compresses a spring.

Statement 8. A method comprising: running a scraper tool into a wellbore with blades retracted; pumping fluid to increase a pressure differential across a choke in the tool to move a mandrel forward, compress a spring, and rotate a j-slot to a second position from a first position to extend the blades; and reducing flow to move the mandrel to a third position on the j-slot to lock the extended blades in place.

Statement 9. The method of the statement 8, further comprising scraping casing within the wellbore.

Statement 10. The method of the statement 8 or 9, further comprising increasing the flow to create a pressure differential across the choke to rotate the j-slot from the third position back to the second position.

Statement 11. The method of any one of the statements 8-10, further comprising reducing the flow to move the mandrel back into the first position.

Statement 12. The method of any one of the statements 8-11, wherein the choke is moveable based on pressure within the tool.

Statement 13. A scraper tool comprising: a rotating j-slot; a spring a deployment mandrel adjacent to the rotating j-slot; blades operable to extend or retract due to movement of the mandrel; and a flow restriction at a distal end of the mandrel, the flow restriction operable to allow movement of the mandrel in a forward direction to compress the spring to rotate the rotating j-slot, due to pressure within the tool.

Statement 14. The scraper tool of the statement 13, wherein the flow restriction comprises an expandable seat operable to catch or release a dropped ball.

Statement 15. The scraper tool of the statement 13 or 14, wherein the flow restriction comprises a choke.

Statement 16. The scraper tool of any one of the statements 13-15, wherein the spring is operable to retract the blades based on pressure within the tool.

Statement 17. The scraper tool of any one of the statements 13-16, wherein the spring is operable to extend the blades based on pressure within the tool.

Statement 18. The scraper tool of any one of the statements 13-17, wherein the rotating j-slot is operable to position the blades.

Statement 19. The scraper tool of any one of the statements 13-18, wherein the expandable seat operable to expand upon reaching an outlet of the scraper tool.

Statement 20. The scraper tool of any one of the statements 13-19, wherein the rotating j-slot is operable to retract the blades, extend the blades, and lock the blades in place.

Although the present disclosure and its advantages have been described in detail, it should be understood that various changes, substitutions and alterations may be made herein without departing from the spirit and scope of the disclosure as defined by the appended claims. The preceding description provides various examples of the systems and methods of use disclosed herein which may contain different method steps and alternative combinations of components. It should be understood that, although individual examples may be discussed herein, the present disclosure covers all combinations of the disclosed examples, including, without limitation, the different component combinations, method step combinations, and properties of the system. It should be understood that the compositions and methods are described in terms of "comprising," "containing," or "including" various components or steps, the compositions and methods can also "consist essentially of" or "consist of" the various components and steps. Moreover, the indefinite articles "a" or "an," as used in the claims, are defined herein to mean one or more than one of the elements that it introduces.

For the sake of brevity, only certain ranges are explicitly disclosed herein. However, ranges from any lower limit may be combined with any upper limit to recite a range not explicitly recited, as well as ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present examples are well adapted to attain the ends and advantages mentioned as well as those that are inherent therein. The particular examples disclosed above are illustrative only and may be modified and practiced in different but equivalent manners apparent to those skilled in the art having the benefit of the teachings herein. Although individual examples are discussed, the disclosure covers all combinations of all of the examples. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative examples disclosed above may be altered or modified and all such variations are considered within the scope and spirit of those examples. If there is any conflict in the usages of a word or term in this specification and one or more patent(s) or other documents that may be incorporated herein by reference, the definitions that are consistent with this specification should be adopted.

What is claimed is:

1. A method comprising:

running a scraper tool into a wellbore, wherein the scraper tool comprises a plurality of blades in a retracted position;

dropping a ball into an expandable seat of the scraper tool;

pumping a fluid into the scraper tool to increase from a first pressure to a second pressure, wherein based on reaching the second pressure, the scraper tool is configured to:

deploy a mandrel to move the plurality of blades to an extended position; and rotate a j-slot from a first position to a second position; and pumping the fluid into the scraper tool to increase from the second pressure to a third pressure, wherein based on reaching the third pressure, the scraper tool is configured to:

release the ball from the expandable seat to return to the first pressure; and rotate the j-slot from the second position to a third position to lock the plurality of blades in the extended position, wherein the j-slot remains in the second position while increasing from the second pressure to the third pressure.

2. The method of claim 1, further comprising scraping a casing within the wellbore.

3. The method of claim 2, further comprising dropping a second ball into the expandable seat to build to the second pressure.

4. The method of claim 3, wherein based on reaching the second pressure, the scraper tool is configured to: rotate the j-slot back to the second position from the third position.

5. The method of claim 4, further comprising building to the third pressure to release the second ball.

6. The method of claim 5, wherein based on reaching the first pressure, the scraper tool is configured to: move the j-slot back to the first position.

7. The method of claim 1, wherein deployment of the mandrel compresses a spring.

8. A method comprising:

running a scraper tool into a wellbore with blades in a retracted position;

pumping fluid to increase a pressure differential across a choke in the scraper tool to move a mandrel forward, compress a spring, and rotate a j-slot to a second position from a first position to move the blades to an extended position; and reducing flow to move the mandrel to a third position on the j-slot to lock the blades in the extended position, wherein the choke is a solid piece, and wherein the choke is fixed with respect to the mandrel via a threaded connection.

9. The method of claim 8, further comprising scraping a casing within the wellbore.

10. The method of claim 8, further comprising increasing the flow to create a second pressure differential across the choke to rotate the j-slot from the third position back to the second position.

11. The method of claim 10, further comprising reducing the flow to move the mandrel back into the first position.

12. The method of claim 8, wherein the choke is moveable based on pressure within the scraper tool.

13. A scraper tool comprising:

a rotating j-slot;

a spring;

a mandrel adjacent to the rotating j-slot;

blades operable to extend or retract due to movement of the mandrel; and a solid choke threaded onto a distal end of the mandrel, wherein the solid choke is operable to allow movement of the mandrel in a forward direction to compress the spring and to rotate the rotating j-slot due to a pressure within the scraper tool.

14. The scraper tool of claim 13, wherein the spring is operable to retract the blades based on the pressure within the scraper tool.

15. The scraper tool of claim 13, wherein the spring is operable to extend the blades based on the pressure within the scraper tool.

16. The scraper tool of claim 13, wherein the rotating j-slot is operable to position the blades.

17. The scraper tool of claim 13, wherein the rotating j-slot is operable to retract the blades, extend the blades, and lock the blades in place.

18. The scraper tool of claim 13, wherein the rotating j-slot rotates from a first to a second position.

19. The scraper tool of claim 18, wherein while the pressure is present, the rotating j-slot remains in the second position.

20. The scraper tool of claim 19, wherein a reduction in pressure causes the rotating j-slot to rotate from the second position to a third position.

* * * * *